US006559805B2

(12) United States Patent
Yamauchi et al.

(10) Patent No.: US 6,559,805 B2
(45) Date of Patent: May 6, 2003

(54) ANTENNA APPARATUS

(75) Inventors: Hidetaka Yamauchi, Tokyo (JP); Ichiro Shirokawa, Tokyo (JP); Tomoaki Fukushima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,291

(22) Filed: Nov. 8, 2001

(65) Prior Publication Data

US 2002/0140620 A1 Oct. 3, 2002

(30) Foreign Application Priority Data

Mar. 29, 2001 (JP) ..... 2001-095092

(51) Int. Cl.[7] ..... H01Q 3/00
(52) U.S. Cl. ..... 343/766; 343/765; 343/882
(58) Field of Search ..... 343/765, 766, 343/840, 878, 880, 881, 882

(56) References Cited

U.S. PATENT DOCUMENTS

| | | | | |
|---|---|---|---|---|
| 4,209,789 A | | 6/1980 | Snedkerud | 343/765 |
| 5,485,169 A | | 1/1996 | Kitabatake et al. | 343/765 |
| 5,528,250 A | | 6/1996 | Sherwood et al. | 343/711 |
| 5,579,018 A | * | 11/1996 | Francis et al. | 343/757 |

FOREIGN PATENT DOCUMENTS

| | | |
|---|---|---|
| GB | 2 266 996 | 11/1993 |
| JP | 5-67909 | 3/1993 |
| JP | 9199924 | 7/1997 |
| JP | 9214235 | 8/1997 |
| JP | 2000174535 | 6/2000 |

* cited by examiner

*Primary Examiner*—Tan Ho
(74) *Attorney, Agent, or Firm*—Oblon, Spivak, McClelland, Maier & Neustadt, P.C.

(57) ABSTRACT

There is disclosed an antenna apparatus used for satellite communication or the like and including an antenna rotating in an azimuth angle direction and an elevation angle direction, which can be miniaturized without using a slip ring for ensuring electrical connection between a stationary portion and a movable portion. A rotary member 3 is rotated by rotation of a motor 5 to rotate an antenna 11 about an azimuth axis. On the other hand, a motor 9 is rotated to rotate a rotary member 7, and a relative rotary shaft 14 is rotated by relative rotation between the rotary member 3 and the rotary member 7. The rotation of the relative rotary shaft 14 rotates the antenna 11 about an elevation angle axis by rotation transmission through a bevel gear 18 and a bevel gear 19.

7 Claims, 4 Drawing Sheets

ANTENNA APPARATUS

BACKGROUND OF THE INVENTION

1. Field of the Invention

The present invention relates to an antenna apparatus used for satellite communication or the like and including an antenna rotating in an azimuth angle direction and an elevation angle direction.

2. Description of the Related Art

An antenna apparatus for satellite communication catches or follows a communication satellite by combining the driving of an antenna in an azimuth angle direction with the driving thereof in an elevation angle direction correspondingly to the position of the communication satellite on an orbit, which is a communications partner, and carries out microwave communication with the communication satellite. This type of antenna apparatus is installed in a control center on the ground, and in addition, there is a case where it is used for an SNG (Satellite News Gathering) system in which it is mounted in a moving vehicle and carries out communication with a parent station through a communication satellite, or is mounted in a ship or an aircraft and is used.

For example, a structural example of a conventional antenna apparatus of this type is disclosed in Japanese Patent Laid-Open No. 175716/1993. In this conventional antenna apparatus, a horizontal stabilizing base is provided to be rotatable about a longitudinal shaft by a stationary shaft and a rotary shaft fitted to each other, and it is supported on the horizontal stabilizing base rotatably in the elevation angle direction, and an antenna is provided on this horizontal stabilizing base rotatably in the elevation angle direction. In this conventional antenna apparatus, a control signal for elevation angle driving is transmitted from the side of the stationary shaft to the side of the horizontal stabilizing base through a slip ring provided around the longitudinal shaft, and the antenna can be rotated in the elevation angle direction by an elevation angle rotation driving portion provided on the horizontal stabilizing base. Since an RF signal for antenna transmission and reception is transmitted to the side of the horizontal stabilizing base through a rotary joint, the horizontal stabilizing base for mounting the antenna is structured to be capable of endless rotating with respect to the stationary side.

Japanese Patent Laid-Open No. 199924/1997 discloses another structural example of a conventional antenna apparatus. This conventional antenna apparatus includes such a structure, as a driving mechanism for rotating an antenna in the elevation angle direction, that a main shaft is coupled with an arm for holding the antenna, a hinge is provided at an intermediate portion between the antenna and the main shaft, and the main shaft is moved vertically by an elevation angle rotating motor provided at a stationary side. The rotation of the elevation angle rotating motor is converted into a linear movement to move the main shaft vertically by a rack and pinion mechanism, and the antenna can be rotated in the elevation angle direction around the hinge by the vertical movement of the main shaft.

In the conventional antenna apparatus disclosed in Japanese Patent Laid-Open No. 175716/1993, since the elevation angle rotation driving portion is provided on the horizontal stabilizing base, in order to transmit the control signal to the elevation angle rotation driving portion from the stationary side, it is necessary to dispose the slip ring around the longitudinal shaft. This slip ring has such a structure that a ring-like electrode provided on one of the stationary shaft and the rotary shaft is brought into contact with a brush provided on the other, and is an electric part in which abrasion occurs between the ring-like electrode and the brush. In an aircraft and a ship, or also in a moving vehicle or the like, a communication equipment is often required to have high reliability, and there has been a problem that the reliability of the antenna apparatus is lowered by the slip ring used in the conventional antenna apparatus.

Besides, in the conventional antenna apparatus disclosed in Japanese Patent Laid-Open No. 199924/1997, the elevation angle rotating motor is disposed at the stationary side, and a slip ring as in the antenna apparatus disclosed in Japanese Patent Laid-Open No. 175716/1993 is not included. However, in order to rotate the antenna in the elevation angle direction, it becomes necessary to move the main shaft vertically, and there has been a problem that the antenna apparatus is enlarged by the vertical linear movement stroke of the main shaft. The linear movement stroke can be shortened by decreasing the distance between the hinge portion of the antenna and the main shaft, however, in that case, a torque for antenna driving becomes high, and the elevation angle rotating motor provided at the stationary side becomes large. Besides, when attention is paid to a holding force for holding the antenna position against a disturbance torque due to wind force applied to the antenna or vibration, since a speed reduction ratio can not be ensured by the rack and pinion provided on the main shaft, it is necessary that the motor is enlarged to increase the holding torque, or a gear having a high speed reduction ratio is provided between the rack and pinion and the elevation angle rotating motor to increase the holding torque. There arise a problem of enlargement of the elevation angle rotating motor in the former case and a problem of enlargement of the gear portion or accuracy thereof in the latter case. In this respect, in this type of antenna apparatus mounted especially in an aircraft or a ship, or in a moving vehicle or the like, high reliability and miniaturization/lightening of the antenna apparatus is required.

SUMMARY OF THE INVENTION

The present invention has been made to solve the foregoing problems, and an object thereof is to provide an antenna apparatus which can be miniaturized without using a slip ring for ensuring electrical connection between a stationary portion and a movable portion.

According to a first aspect of the present invention, an antenna apparatus includes a base portion, a first rotary member supported on the base portion and provided rotatably about an azimuth axis, a first motor provided on the base portion and for rotating the first rotary member, a second rotary member supported on the base portion and provided rotatably about a same axis as the first rotary member, a second motor provided on the base portion and for rotating the second rotary member, a relative rotary shaft provided on the first rotary member and rotating by relative rotation between the first rotary member and the second rotary member, and a rotation transmission portion for rotating an antenna provided on the first rotary member about an elevation angle axis by the rotation of the relative rotary shaft.

According to a second aspect of the present invention, in the antenna apparatus of the first aspect, the second rotary member includes gear teeth formed on a circumference around its rotary axis, and the relative rotary shaft includes a gear provided at one end of the shaft and engaging with the gear teeth.

According to a third aspect of the present invention, in the antenna apparatus of the first aspect, the relative rotary shaft includes a shaft member substantially parallel to the azimuth axis, and the rotation transmission portion includes a bevel gear provided at one end of the shaft member, and a bevel gear provided on an elevation angle rotary shaft of the antenna provided on the first rotary member.

According to a forth aspect of the present invention, in the antenna apparatus of the first aspect, the second motor carries out drive control on the basis of an elevation angle setting table describing the relative rotation between the first rotary member and the second rotary member corresponding to an elevation angle of the antenna.

According to a fifth aspect of the present invention, an antenna apparatus includes a base portion, a first rotary member supported on the base portion and provided rotatably about an azimuth axis, a first motor provided on the base portion and for rotating the first rotary member, a second rotary member supported on the base portion and provided rotatably about a same axis as the first rotary member, a second motor provided on the base portion and for rotating the second rotary member, an antenna provided on the first rotary member and rotatably supported about an elevation angle axis, and a link member for connecting a support point provided at a position of the antenna offset from the elevation angle axis and a support point provided on the second rotary member and for rotating the antenna about the elevation angle axis by relative rotation between the first rotary member and the second rotary member.

According to a sixth aspect of the present invention, in the antenna apparatus of the fourth aspect, the link member includes spherical seat bearings at both its ends.

According to a seventh aspect of the present invention, in the antenna apparatus of the first or fourth aspect, the second motor carries out drive control on the basis of an elevation angle setting table describing the relative rotation between the first rotary member and the second rotary member corresponding to an elevation angle of the antenna.

According to the invention of the first to seventh aspects of the present invention, since the antenna can be rotated about the azimuth axis and the elevation angle axis by the motor provided on the base portion, it is not necessary to provide a slip ring of an abrasion part as in the prior art, and high reliability and miniaturization of the antenna apparatus can be realized.

DETAILED DESCRIPTION OF THE PREFERRED EMBODIMENTS

Embodiment 1

Figure 1:
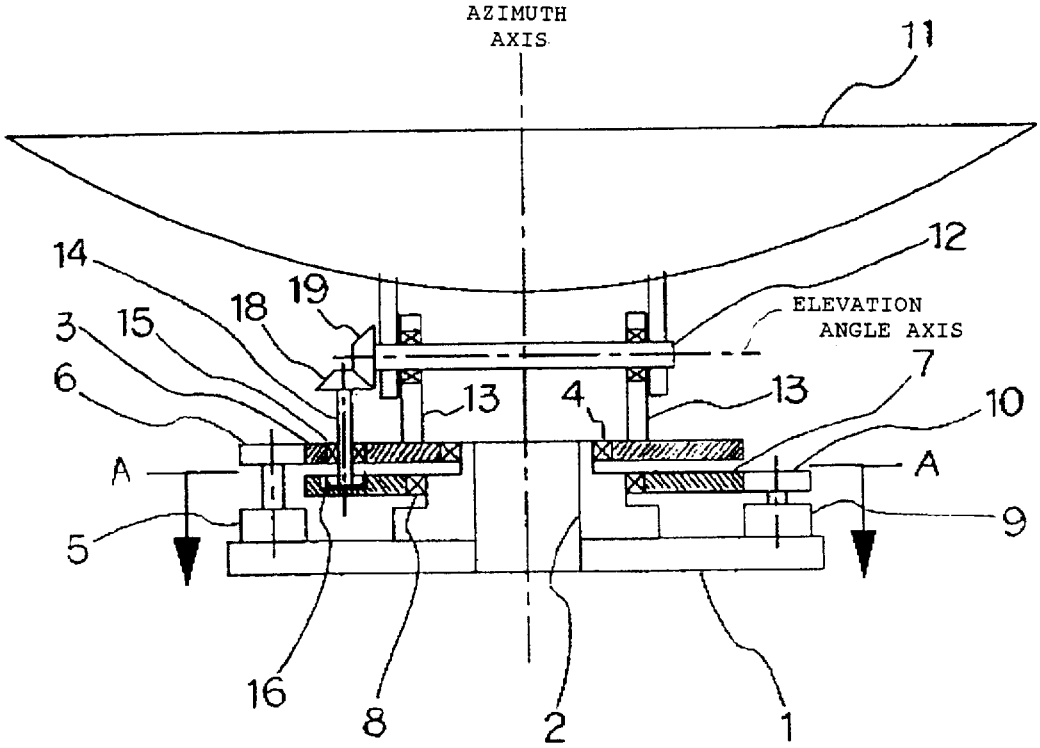
FIG. 1 is a structural view showing a structure of an antenna apparatus according to embodiment 1 of the present invention.
Figure 2:
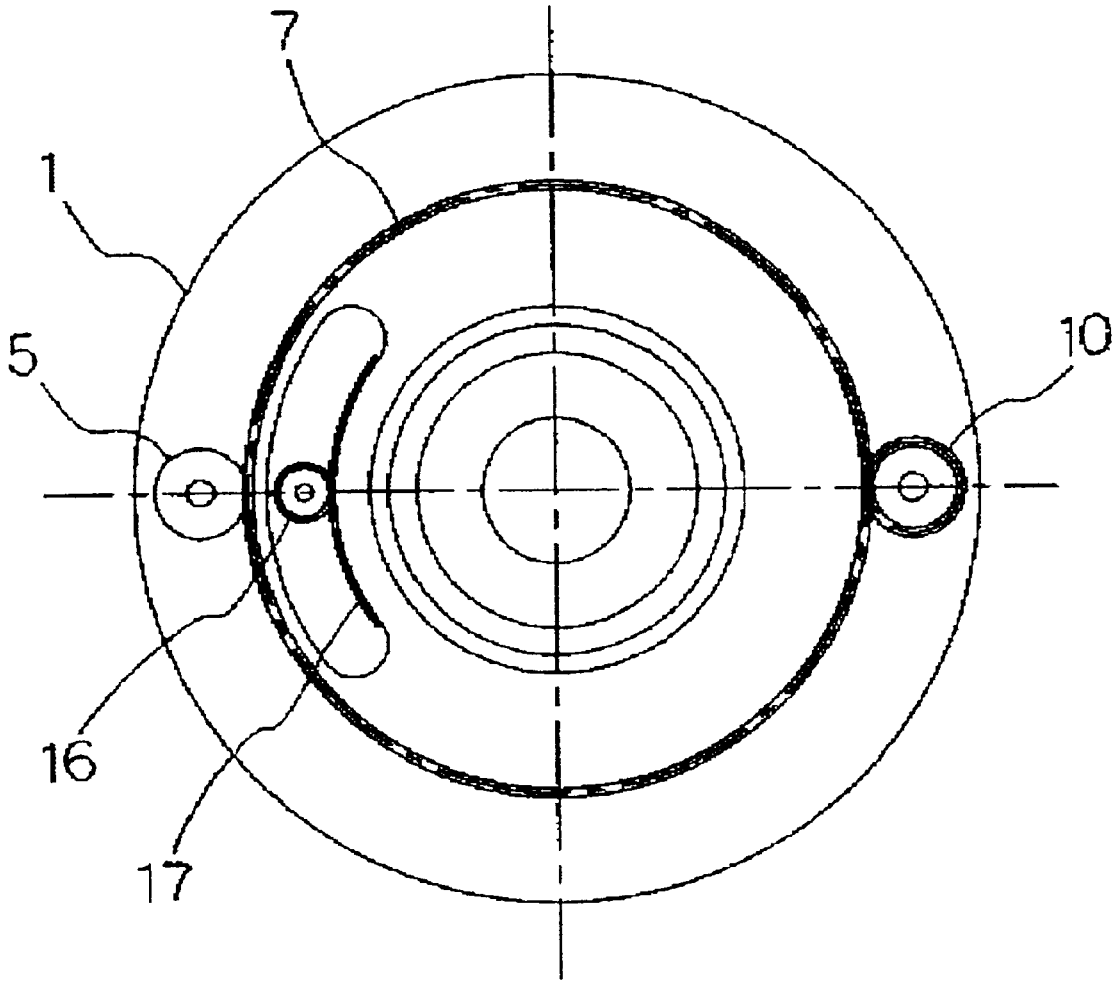
FIG. 2 is a sectional view showing the structure of the antenna apparatus according to the embodiment 1 of the present invention seen from line A—A in FIG. 1.

An antenna apparatus according to embodiment 1 of the present invention will be described with reference to FIG. 1 and FIG. 2. FIG. 1 is a structural view showing the structure of the antenna apparatus according to the embodiment 1, and FIG. 2 is a sectional view showing the antenna apparatus according to the embodiment 1 seen from line AA in FIG. 1. In FIG. 1, reference numeral 1 designates a base portion for installing the antenna apparatus on the ground or attaching it to a movable body; and 2, a stationary shaft fixedly provided on the base portion and having a stepped cylindrical shape with an azimuth axis direction as a shaft direction. Reference numeral 3 designates a first rotary member (hereinafter simply referred to as a rotary member 3) supported on the stationary shaft 2 rotatably in the azimuth angle direction and having a disk shape; and 4, a bearing provided at a coupling portion between the rotary member 3 and the stationary shaft 2. Reference numeral 5 designates a first motor (hereinafter simply referred to as a motor 5) for rotating the rotary member 3 about an azimuth angle axis; and 6, a gear provided on a rotary shaft of the motor 5 and engaging with a gear formed on an outer periphery of the rotary member 3. Reference numeral 7 designates a second rotary member (hereinafter simply referred to as a rotary member 7) supported on the stationary shaft 2 rotatably in the azimuth angle direction and having a disk shape; and 8, a bearing provided at a coupling portion between the rotary member 7 and the stationary shaft 2. Reference numeral 9 designates a second motor (hereinafter simply referred to as a motor 9) for rotating the rotary member 7 about the azimuth angle axis; and 10, a gear provided on the rotary shaft of the motor 9 and engaging with a gear formed at an outer periphery of the rotary member 7. Reference numeral 11 designates an antenna driven at a predetermined angle in the azimuth angle and the elevation angle and carrying out wireless communication with an opposite communication station. Reference numeral 12 designates an elevation angle rotary shaft provided on the antenna 11; and 13, a supporting leg for supporting the elevation angle rotary shaft 12. The antenna 11 is provided on the rotary member 3 rotatably in the elevation angle direction through the support leg 13. Reference numeral 14 designates a relative rotary shaft rotating by relative rotation between the rotary member 3 and the rotary member 7; and 15, a bearing for rotatably supporting the relative rotary shaft 14 with respect to the rotary member 3. This bearing 15 is fitted into a hole formed in the rotary member 3. Reference numeral 16 designates a gear provided at one end of the relative rotary shaft and engaging with gear teeth 17 provided on the rotary member 7 shown in FIG. 2. The gear teeth 17 are gear teeth provided on the periphery around the rotary shaft of the rotary member 7, and are constituted by gear teeth formed in an arc-shaped groove provided in the rotary member 7. Reference numeral 18 designates a bevel gear provided at the other end of the relative rotary shaft 14; and 19, a bevel gear provided at one end of the elevation angle rotary shaft 12. The bevel gear 18 and the bevel gear 19 are engaged with each other to form a rotation transmission portion for rotating the antenna 11 about the elevation angle axis.

Next, the operation of the antenna apparatus of this embodiment 1 will be described. The rotary member 3 is rotated by rotation of the motor 5. The antenna 11 is rotated about the azimuth axis by this rotation. On the other hand, the rotary member 7 is rotated by rotation of the motor 9. The relative rotary shaft 14 is rotated by the relative rotation between the rotary member 3 and the rotary member 7. The rotation of the relative rotary shaft 14 rotates the antenna 11 about the elevation angle axis by rotation transmission through the bevel gear 18 and the bevel gear 19. In the case where the antenna 11 is rotated only in the azimuth angle direction, the motor 5 and the motor 9 are rotated so as not to cause the relative rotation between the rotary member 3 and the rotary member 7. In the case where it is desired to rotate the antenna 11 only about the elevation angle axis while the azimuth direction of the antenna 11 remains the same, the motor 5 is put in a stop state not to rotate the rotary member 3, and the motor 9 is rotated to rotate the rotary member 7. In this way, since the antenna 11 can be rotated about the azimuth axis and the elevation angle axis by the motor 5 and the motor 9 provided on the base portion 1, it is not necessary to provide a slip ring of an abrasion part as in the prior art, and the reliability of the antenna apparatus can be raised. Besides, as described above, since a linear movement mechanism is not provided in the elevation angle driving of the antenna 11, it is not necessary to ensure the linear stroke, and accordingly, a housing property can be improved and miniaturization of the antenna apparatus can be realized.

Incidentally, the rotation transmission mechanism between the rotary member 3 and the motor 5, between the rotary member 7 and the motor 9, between the relative rotary shaft 14 and the rotary member 7, and between the bevel gear 18 and the bevel gear 19 described in this embodiment are not respectively limited to the rotation transmission mechanism by the gear as shown in FIG. 1, and within the range not departing from the gist of this invention, various modifications to the rotation transmission mechanism, for example, the modification to adopt a belt rotation transmission mechanism instead of the gear can be carried out.

Embodiment 2

Figure 3:
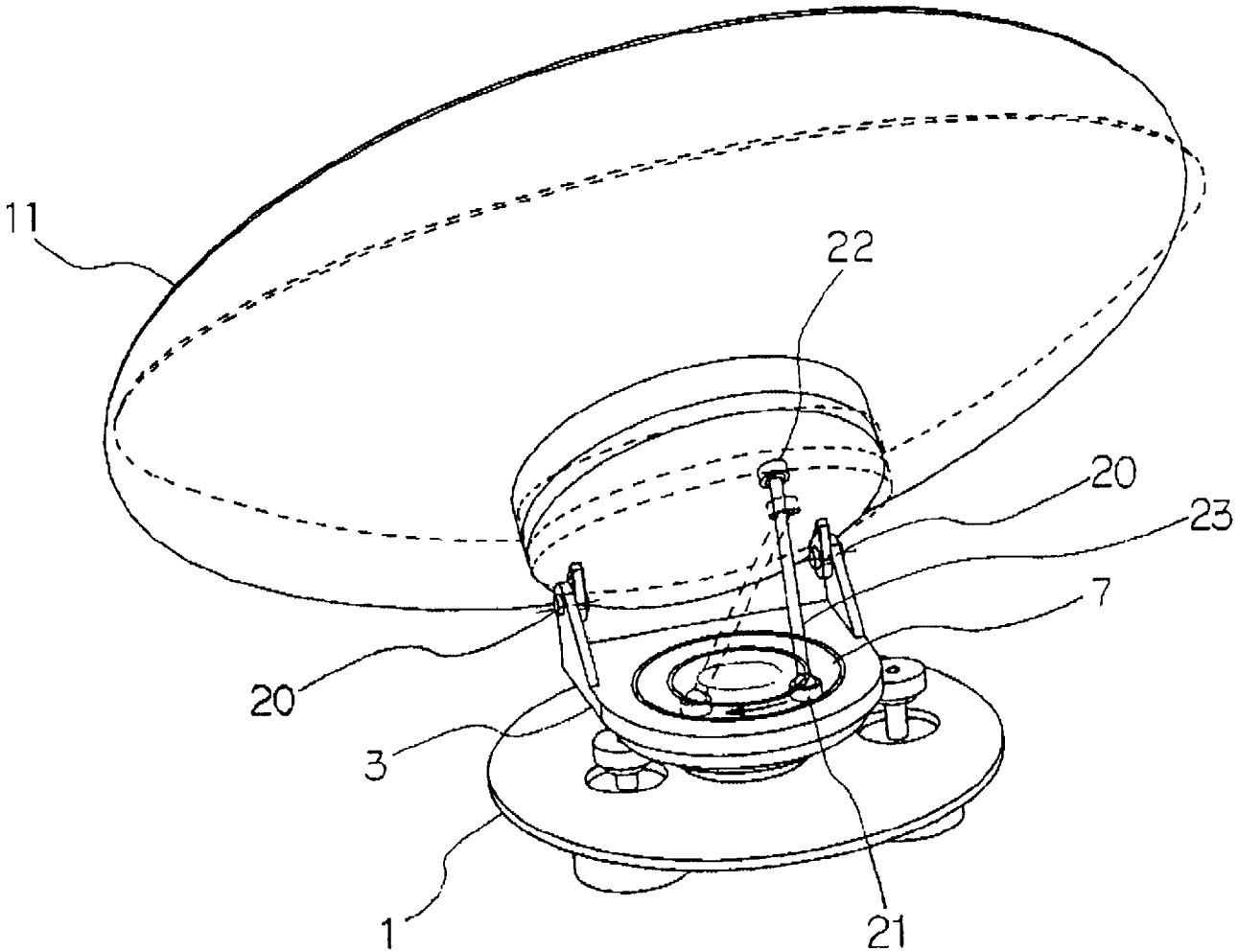
FIG. 3 is an external appearance view showing a structure of an antenna apparatus according to embodiment 2 of the present invention.
Figure 4:
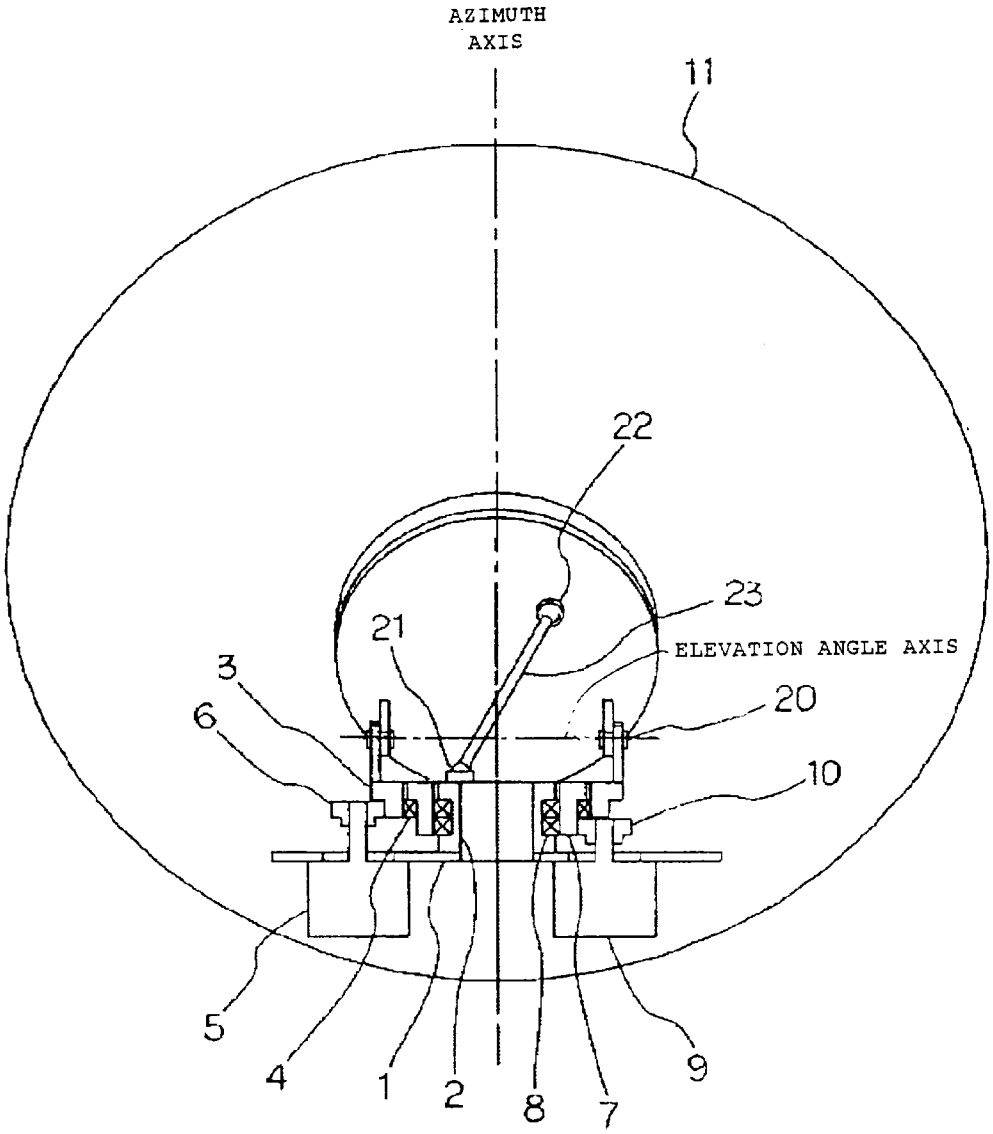
FIG. 4 is a sectional view passing an azimuth rotation axis of the antenna apparatus according to the embodiment 2 of the present invention.

Next, an antenna apparatus according to embodiment 2 of the present invention will be described with reference to FIGS. 3 and 4. FIG. 3 is an external appearance view showing the structure of the antenna apparatus according to the second embodiment, and FIG. 4 is a sectional view with a section passing an azimuth rotation axis of the antenna apparatus of the second embodiment. In FIG. 3, reference numeral 20 designates a hinge for supporting an antenna 11 to enable elevation angle rotation, and the antenna 11 is coupled to a rotary member 3 through the hinge 20. Reference numeral 21 designates a support point provided on a rotary member 7; and 22, a support point provided on the antenna 11. Reference numeral 23 designates a rod-like link member coupling the support point 21 and the support point 22. One end of the link member 23 is supported through the support point 21 rotatably in three degrees of freedom with respect to the rotary member 7 and three translation degrees of freedom are restricted. The other end of the link member 23 is supported through the support point 22 rotatably in three degrees of freedom with respect to the antenna 11 and three translation degrees of freedom are restricted. For example, the support point 21 and the support point 22 are coupled with the link member 23 through spherical bearings. In FIGS. 3 and 4, parts designated by the same characters as those of FIG. 1 are identical or equivalent portions to those of FIG. 1.

Next, the operation of the antenna apparatus of the embodiment 2 will be described with reference to FIG. 3. The antenna 11 can be rotated about the azimuth axis by rotating the rotary member 3. On the other hand, with respect to the rotation about the elevation angle axis, by relative rotation of the rotary member 7 with respect to the rotary member 3, the support point 21 moves about the azimuth axis so that the position of the link member 23 is changed, and further, the support point 22 is moved so that the antenna 11 can be rotated about the elevation angle axis by the hinge 20. That is, the azimuth angle and the elevation angle of the antenna 11 can be changed by the rotation of the rotary member 3 and the rotary member 7. The change of the elevation angle of the antenna 11 occurs in such a manner that for example, the link member 23 positioned at a real line shown in FIG. 3 is moved to a position of a broken line by rotation (rotation of an arrow shown in the drawing) of the rotary member 7, so that the antenna 11 is moved from the position of a real line to the position of a broken line. When this is seen in FIG. 4, a gear 6 is rotated by rotation of a motor 5, and the gear 6 is engaged with gear teeth provided on the outer periphery of the rotary member 3 to rotate the rotary member 3. A gear 10 is rotated by rotation of a motor 9, and the gear 10 is engaged with gear teeth provided on the outer periphery of the rotary member 7 to rotate the rotary member 7. By the rotation of the rotary member 3 and the rotary member 7, as described above, the antenna 11 can be rotated about the azimuth axis and the elevation angle axis. Although the relation in which the rotary member 7 is supported to a stationary shaft 2 through a bearing 8 is the same as the embodiment 1, it is different from the structure of the embodiment 1 in that the rotary member 3 is supported on the rotary member 7 through the bearing 4. Since the rotary member 7 is supported on the stationary shaft 2 rotatably in the azimuth angle direction, eventually, it can be said that the rotary member 3 is supported with respect to the stationary shaft 2 rotatably about the azimuth axis.

Like this, since the antenna 11 can be rotated about the azimuth axis and the elevation angle axis by the motor 5 and the motor 9 provided on the base portion 1, it is not necessary to provide a slip ring of an abrasion part as in the prior art, and the reliability of the antenna apparatus can be raised. Besides, in the elevation angle driving of the antenna 11 as described above, since a linear movement mechanism is not provided, it is not necessary to ensure the linear movement stroke, and accordingly, a housing property can be improved and miniaturization of the antenna apparatus can be realized.

Incidentally, the rotation transmission mechanism between the rotary member 3 and the motor 5, and between the rotary member 7 and the motor 9 described in this embodiment are not respectively limited to the rotation transmission mechanism by the gear described in FIG. 4, and within the range not departing from the gist of this invention, various modifications to the rotation transmission mechanism, for example, the modification to adopt a belt rotation transmission mechanism instead of the gear can be carried out.

Embodiment 3

As described in the embodiment 1 and the embodiment 2, the antenna 11 can be rotated about the azimuth axis and the elevation angle axis by the rotation of the motor 5 and the motor 9. In this embodiment, a driving control method of the motor 5 and the motor 9 will be described.

With respect to the rotation of the antenna 11 about the azimuth axis, the motor 5 and the motor 9 are driven so that the amount of rotation of the rotary member 3 becomes equal to that of the rotary member 7. On the other hand, the rotation of the antenna 11 about the elevation angle axis is caused by causing the relative rotation between the rotary member 3 and the-rotary member 7. The rotation of the motor 9 is correlated with the rotation of the antenna 11 about the elevation angle axis, in the embodiment 1, by the rotation transmission through the gear 10, the rotation transmission through the gear 16, and the rotation transmission through the bevel gears 18 and 19. In the embodiment 2, the rotation of the motor 9 is correlated with the rotation of the antenna 11 about the elevation angle axis by the rotation transmission through the gear 10 and the position change of the link member 23. That is, in the embodiment 1 and the embodiment 2, the relation of the rotation of the motor 9 corresponding to the elevation angle of the antenna 11 or the relative rotation between the rotary member 3 and the rotary member 7 is obtained. In either embodiment, the rotation angle (or rotation position) of the motor 9 corresponding to the rotation angle (or rotation position) of the antenna 11 about the elevation angle axis or the relation of the relative rotation angle (or rotation positions) between the rotary member 3 and the rotary member 7 can be experimentally measured in advance after assembly of the antenna apparatus. An elevation angle setting table in which the measured results are described is stored in a memory of a motor driving control portion, and in the case where an instruction of elevation angle driving of the antenna 11 is given, the rotation amount (or rotation position) of the motor 9 corresponding to a necessary elevation angle rotation amount (or elevation angle rotation position), or the relative rotation angle between the rotary member 3 and the rotary member 7 is read out, and the motor 9 is controlled to rotate. Especially in the embodiment 2, the position of the link member 23 relates to elevation angle rotation of the antenna 11, and the antenna 11 can be driven by a simple calculation processing as compared with driving of the motor 9 by solving a complicated geometric relation.

What is claimed is:

1. An antenna apparatus, comprising:

a base portion;

a disk-shaped first rotary member supported on the base portion and provided rotatably about an azimuth axis;

a first motor provided on the base portion and for rotating the first rotary member;

a disk-shaped second rotary member supported on the base portion and provided rotatably about a same axis as the first rotary member;

a second motor provided on the base portion and for rotating the second rotary member;

a relative rotary shaft provided on the first rotary member and rotating by relative rotation between the first rotary member and the second rotary member; and a rotation transmission portion for rotating an antenna provided on the first rotary member about an elevation angle axis by the rotation of the relative rotary shaft.

2. An antenna apparatus according to claim 1, wherein the second rotary member includes gear teeth formed on a circumference around its rotary axis, and the relative rotary shaft includes a gear provided at one end of the shaft and engaging with the gear teeth.

3. An antenna apparatus according to claim 1, wherein the relative rotary shaft includes a shaft member substantially parallel to the azimuth axis, and the rotation transmission portion includes a bevel gear provided at one end of the shaft member, and a bevel gear provided on an elevation angle rotary shaft of the antenna provided on the first rotary member.

4. An antenna apparatus according to claim 1 wherein the second motor carries out drive control on the basis of an elevation angle setting table describing the relative rotation between the first rotary member and the second rotary member corresponding to an elevation angle of the antenna.

5. An antenna apparatus, comprising:

a base portion;

a first rotary member supported on the base portion and provided rotatably about an azimuth axis;

a first motor provided on the base portion and for rotating the first rotary member;

a second rotary member supported on the base portion and provided rotatably about a same axis as the first rotary member;

a second motor provided on the base portion and for rotating the second rotary member;

an antenna provided on the first rotary member and rotatably supported about an elevation angle axis; and a link member for connecting a support point provided at a position of the antenna offset from the elevation angle axis and a support point provided on the second rotary member and for rotating the antenna about the elevation angle axis by relative rotation between the first rotary member and the second rotary member.

6. An antenna apparatus according to claim 5, wherein the link member includes spherical bearings at both its ends.

7. An antenna apparatus according to claim 5, wherein the second motor carries out drive control on the basis of an elevation angle setting table describing the relative rotation between the first rotary member and the second rotary member corresponding to an elevation angle of the antenna.

* * * * *